US005277625A

United States Patent [19]

Iannella et al.

[11] Patent Number: 5,277,625

[45] Date of Patent: Jan. 11, 1994

[54] ELECTRICAL CONNECTOR WITH TAPE FILTER

[75] Inventors: James F. Iannella, Harrisburg; Paul J. Anastasio; James M. English, Annville, all of Pa.

[73] Assignee: The Whitaker Corporation, Wilmington, Del.

[21] Appl. No.: 971,028

[22] Filed: Nov. 3, 1992

[51] Int. Cl.[5] ..... H01R 13/66

[52] U.S. Cl. ..... 439/620; 439/676

[58] Field of Search ..... 439/607, 620, 676; 333/183, 184

[56] References Cited

U.S. PATENT DOCUMENTS

| | | | |
|---|---|---|---|
| 4,331,948 | 5/1982 | Malinarac et al. | 338/21 |
| 4,371,226 | 2/1983 | Brancaleone | 339/147 R |
| 4,473,755 | 9/1984 | Imai et al. | 307/10 R |
| 4,552,423 | 11/1985 | Swengel, Jr. | 339/19 |
| 4,660,907 | 4/1987 | Belter | 339/14 R |
| 4,679,879 | 7/1987 | Triner et al. | 439/425 |
| 4,695,115 | 9/1987 | Talend | 439/76 |
| 4,714,435 | 12/1987 | Stipanuk et al. | 439/496 |
| 4,726,638 | 2/1988 | Farrar et al. | 439/620 R |
| 4,726,991 | 2/1988 | Hyatt et al. | 428/329 |
| 4,729,752 | 3/1988 | Dawson, Jr. et al. | 439/620 |
| 4,772,224 | 9/1988 | Talend | 439/607 |
| 4,791,391 | 12/1988 | Linnell et al. | 333/184 |
| 4,799,901 | 1/1989 | Pirc | 439/620 |
| 4,804,332 | 2/1989 | Pirc | 439/620 |
| 4,822,304 | 4/1989 | Herron | 439/610 |
| 4,838,811 | 6/1989 | Nakamura et al. | 439/607 |
| 4,878,858 | 11/1989 | Dechelette | 439/607 |
| 4,931,754 | 6/1990 | Moussie | 333/184 |
| 4,950,185 | 8/1990 | Boutros | 439/620 |
| 4,977,357 | 12/1990 | Shrier | 338/21 |
| 4,983,935 | 1/1991 | Mouissie | 333/184 |
| 5,018,989 | 5/1991 | Black et al. | 439/620 |
| 5,068,634 | 11/1991 | Shrier | 338/21 |
| 5,069,641 | 12/1991 | Sakamoto et al. | 439/620 |
| 5,080,595 | 1/1992 | Mouissie | 439/67 |
| 5,082,457 | 1/1992 | Wollscheidt et al. | 439/620 |
| 5,099,380 | 3/1992 | Childers et al. | 361/56 |
| 5,140,299 | 8/1992 | Andrews, Jr. et al. | 338/308 |
| 5,142,263 | 8/1992 | Childers et al. | 338/21 |
| 5,150,086 | 9/1992 | Ito | 333/182 |

OTHER PUBLICATIONS

*Electromer Drawing No. FLX-XXB*001, "Multi-Line ESD Protection Array for D-Submin Connectors", Revision E, Sep. 23, 1991; Electromer Corporation, Belmont, Calif.

*Electromer Drawing No. PCE-SM*01*C*010, "Specification Control Drawing", Revision TM, Apr. 11, 1991; Electromer Corporation, Belmont, Calif.

U.S. Ser. No. 860,948 filed on Mar. 31, 1992 by Lurie et al.

U.S. Ser. No. 949,655 filed on Sep. 23, 1992 by Bunch et al.

U.S Ser. No. 906,813 filed on Jun. 30, 1992 by Collins et al.

*Primary Examiner*—Eugene F. Desmond

*Attorney, Agent, or Firm*—Anton P. Ness; Katherine A. Nelson

[57] ABSTRACT

An electrical connector assembly (10) includes a plurality of signal contacts (22) and a grounding structure (16) mounted in a plastic housing (12) having flat exterior surface portions (19). One or more filter elements (32) contain signal electrodes (34) associated with and electrically connected to respective signal contacts (22) at staggered signal connection sections (35), with ground electrode (38) connected to grounding structure (16) at section (39). Each filter element is in tape form with dielectric material (36) laminated between broad area electrodes (34,38) with the tape attached to the housing exterior surface (14) for the electrodes (34,38) of the filter to be connected between the signal contact and ground structure to effectively insert the filter in the signal path to ground. Each signal electrode (34) may be carried on a separate tape filter, or one tape filter (80) may define at least two signal electrodes (82,84).

15 Claims, 5 Drawing Sheets

ELECTRICAL CONNECTOR WITH TAPE FILTER

FIELD OF THE INVENTION

This invention relates to an electrical article such as a connector and more particularly to such an article having a filter element secured thereto for filtering signals transmitted by circuits thereof.

BACKGROUND OF THE INVENTION

The increasing use of high speed digital pulses for communication has led to the use of sensitive components to receive and manipulate such signals. This sensitivity has in turn made the components vulnerable to unwanted frequencies transmitted thereto on the same signal paths as the wanted signal frequencies. To solve the problem caused thereby, a number of developments have led to patents that purport to filter out unwanted frequencies utilizing electrical connectors as the vehicle for accommodating appropriate filters having appropriate characteristics. U.S. Pat. No. 4,695,115 granted Sep. 22, 1987, is drawn to a telephone connector with bypass capacitor and teaches the use of capacitors built into the connector to filter out unwanted frequencies from signals carried on signal contacts of a connector. There, the filters are termed "tombstone capacitors" and means are provided for interconnecting such capacitors between the signal paths and grounding paths. As will be discerned, the filters occupy a considerable volume of the total volume of the connector.

U.S. Pat. No. 4,772,224 granted Sep. 20, 1988 represents a modular electrical connector which includes capacitors and additionally, ferrite inductors to provide filtering. As with U.S. Pat. No. 4,695,115, the filter elements take up considerable volume of the device, particularly in terms of the height of the device from a printed circuit board or part of the assembly served by the filtered connector.

Accordingly, it is an object of the present invention to provide a connector having a filter that adds minimally to the packaging dimensions of the connector. It is a further object to provide the combination of multipin electrical connector in conjunction with a thin tape filter disposed on the exterior surface of the connector housing in an unobtrusive way, generally conforming to the shape of the exterior surfaces while innocuously traversing openings thereinto. It is a still further object to provide a simple, and readily manufacturable filter construction that adapts itself to use on connectors and other electrical articles such as printed circuit boards and transmission cable.

SUMMARY OF THE INVENTION

In accordance with the present invention, there is provided a filter assembly consisting essentially of one or more thin foil signal electrodes and one or more grounding electrodes separated by a thin coating of dielectric material with the area of the electrodes, in conjunction with the dielectric constant of the material and the spacing between electrodes, selected to provide a capacitance effectively filtering out unwanted frequency components and allowing desired frequency components to pass through signal transmission circuits. The unwanted frequency components are in essence grounded by the filter through a connection to a grounding means. The filter may include the electrodes and dielectric material laminated together, or additionally, a thin dielectric film utilized as a carrier to hold the assembly of electrodes and dielectric material in a position for manufacturing and application. Such a filter element and method for securing it to an electrical article are disclosed in U.S. patent application Ser. No. 07/971,164 filed Nov. 3, 1992 and assigned to the assignee hereof.

In one embodiment, the present invention achieves the foregoing objectives through the use of an electrical connector having a plastic housing with an exterior surface essentially of a conventional configuration. The connector includes signal contacts carried by the housing with post portions extending from the bottom of the housing and a grounding contact, including a shield structure over the front or mating face of the connector, with post portions extending down from the bottom or mounting face of the connector, the post portions to be inserted into respective apertures of the printed circuit board of a circuit assembly being soldered thereto. Signals transmitted to the connector by a mating connector are carried by their signal contacts to signal traces on the circuit assembly through printed circuit board conductive traces extending from connections with the contacts at the apertures, to components within the assembly that receive and utilize such signals for communication purposes.

In combination with the connector, which may be in the form of a telephone receptacle that mates with a telephone connector plug, the electrodes of the filter, both signal and ground, have holes therein through which are fitted the contacts of the connector, suitably terminated thereto such as by solder joints, with the filter tape lamination being thereafter folded around from the bottom of the connector housing, over the back and top of the housing with the grounding electrode being joined to the shielding and grounding of the connector as by solder. An insulative layer is provided over the portions of the electrodes except at the soldering sites, such as by spraying of a polymeric coating thereover or lamination to a polymeric film.

The invention contemplates application for a broad range of connectors, including at least one signal contact and at least one grounding contact with separate tape structures for separate signal contacts in accordance with the size of the capacitor required or with a common ground and separate electrodes for separate signal contacts. The invention also contemplates, in certain applications, a lamination having a common grounding electrode with separate signal electrodes for the filter capacitor. The filter of the invention being as mentioned tape-like and laminated is, in all events, made quite thin and flexible so as to be foldable over and pressed against substantially flat portions of the outside surface of the connector housing and attached thereto as by adhesive or bonding or structures intended to hold the filter in place on the housing so that the connector/-filter assembly can be handled as one element. The filter tapes may be mechanically secured to the connector housing by means of the solder joints with signal and ground contacts of the connector, and optionally further secured by a plastic covering thereover assembled to the connector after soldering. Through this technique, the volumetric change by adding the filter is minimized and the invention is adaptable to existing connector designs, being added thereto in a straightforward assembly technique.

The filter of the present invention can also be utilized with other electrical articles such as printed circuit boards, where the signal and ground electrodes could be soldered directly to exposed contact pads of the board's signal and ground traces, for example. The filter could also be used around a length of shielded signal transmission cable.

An embodiment of the present invention will now be described by way of example with reference to the accompanying drawings.

DETAILED DESCRIPTION OF THE INVENTION

Figure 1:
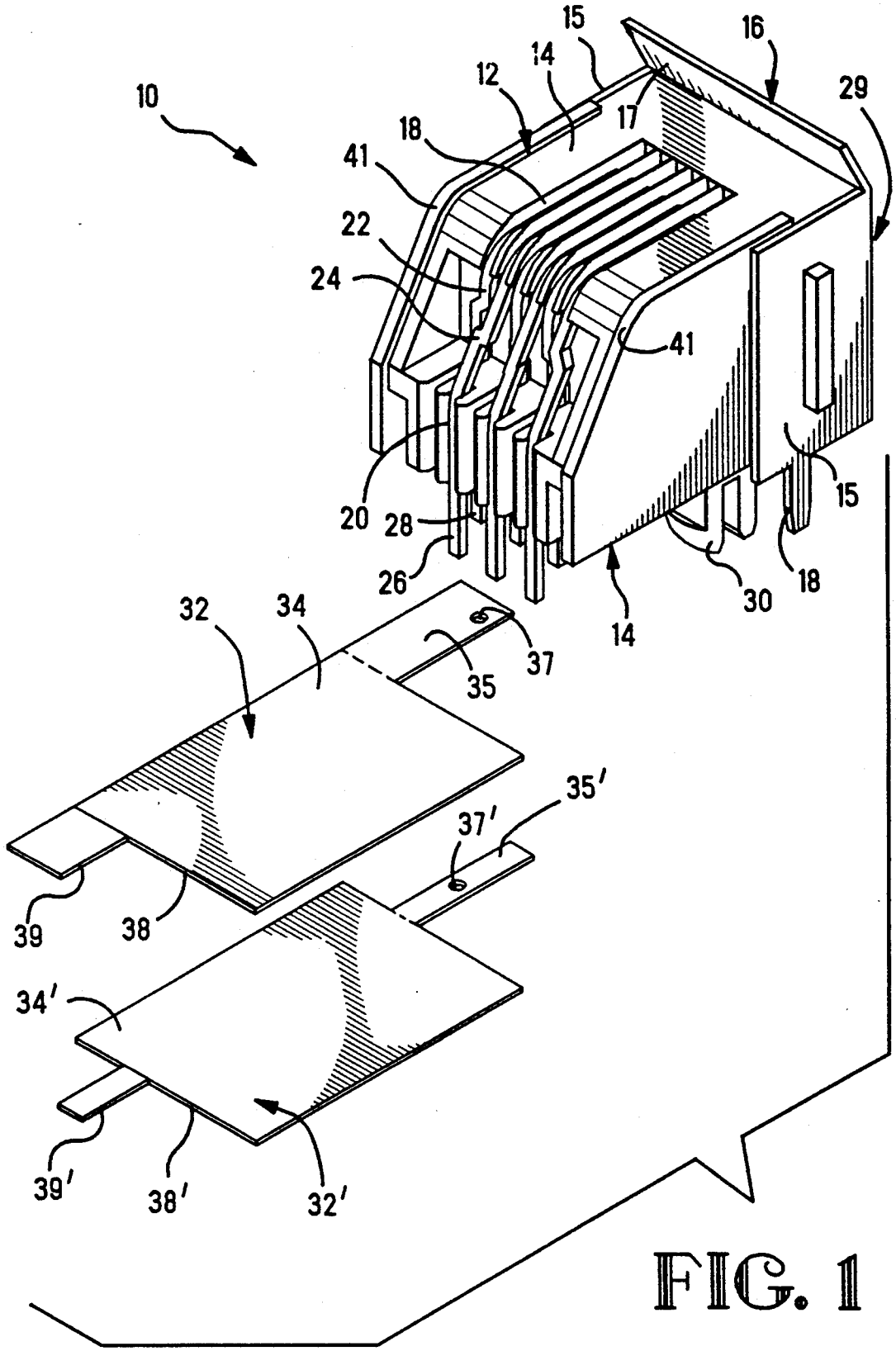
FIG. 1 is an isometric view showing the connector of the invention positioned above two representative tape filters prior to an assembly thereof.

Referring now to FIG. 1, an electrical article such as connector assembly 10 is shown to include a connector 12 and a pair of filters 32 and 32' prior to assembly of connector and filters. The connector 12 may be taken to be a modular telephone receptacle jack of a well known type mountable to a printed circuit board (not shown) at a board connection or mounting face 25. Connector 12 receives into a cavity at a mating face 29, a modular telephone plug (not shown) connected to telephone cable to interconnect such cable and the signals carried thereon through the connectors to the circuit board, telephone receiver, facsimile receiver, and/or computer. The signals transmitted through the plug and jack connectors to the circuit receiving signals may carry unwanted frequencies that find their way onto the cable through radiation of fields, induction, leakage from other circuits and the like. It is these unwanted frequency components that can cause error, particularly with respect to the interpretation of digital 1 and 0 information that makes up digital transmission. It is the purpose of the present invention to filter out the unwanted frequencies while allowing the frequencies that constitute the proper signal representations, namely, voltage levels, to pass through the connector and into the circuit and apparatus receiving such signals.

Figure 2:
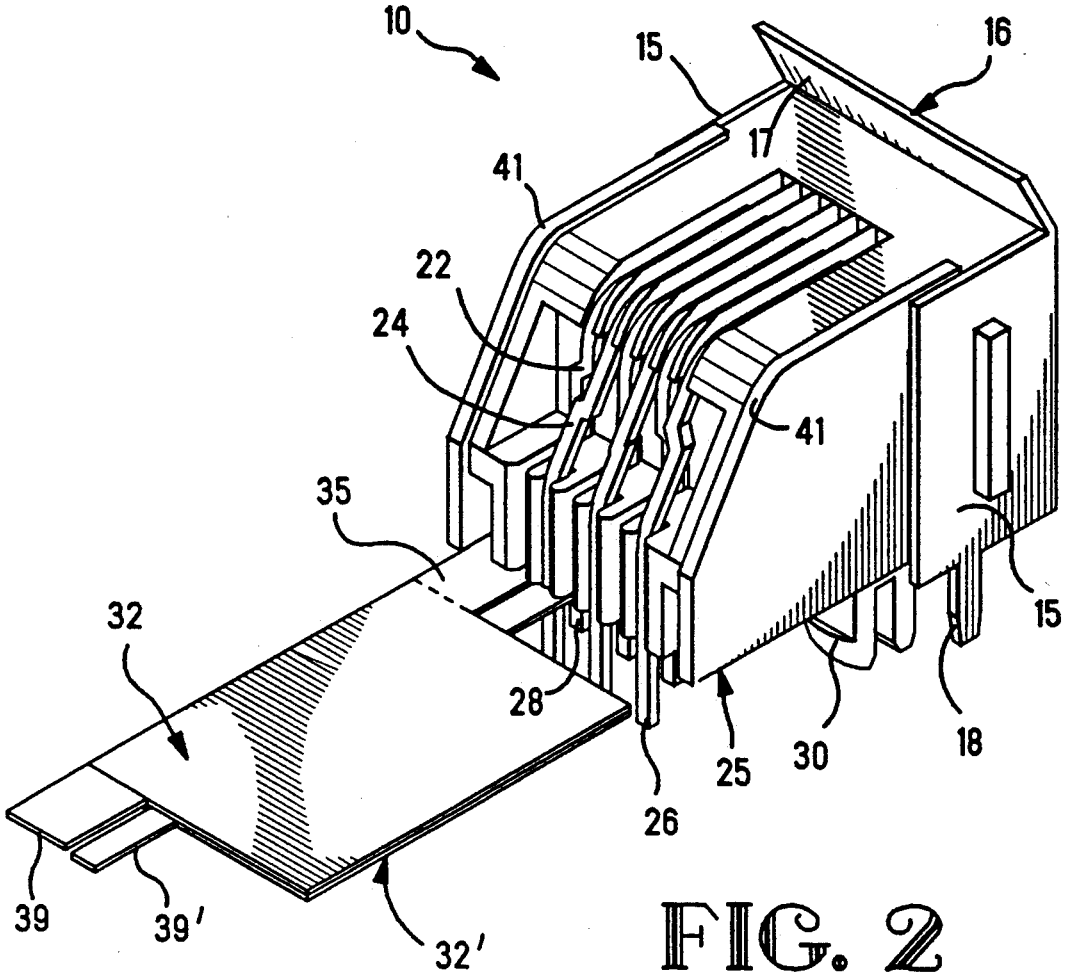
FIG. 2 is a view of the elements of FIG. 1 in partial assembly.
Figure 6:
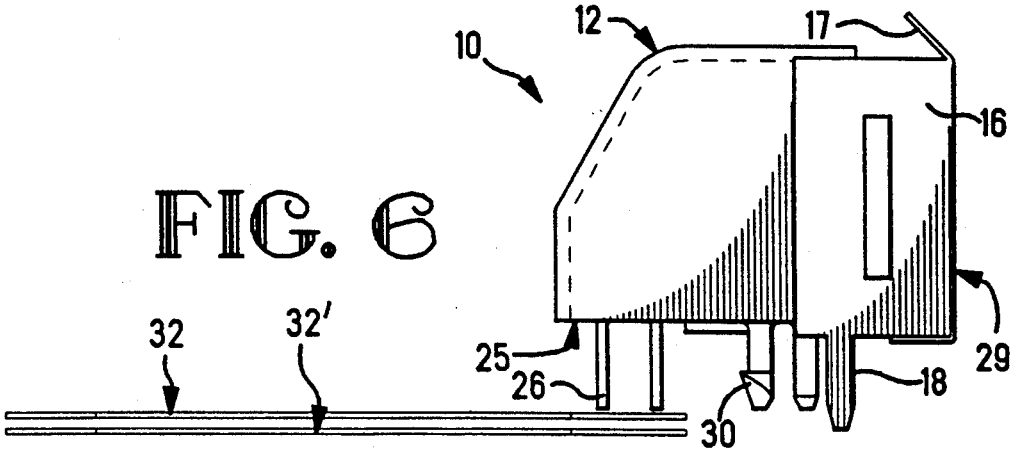
FIG. 6 is a side and elevation view of the connector and filter of FIG. 1.
Figure 7:
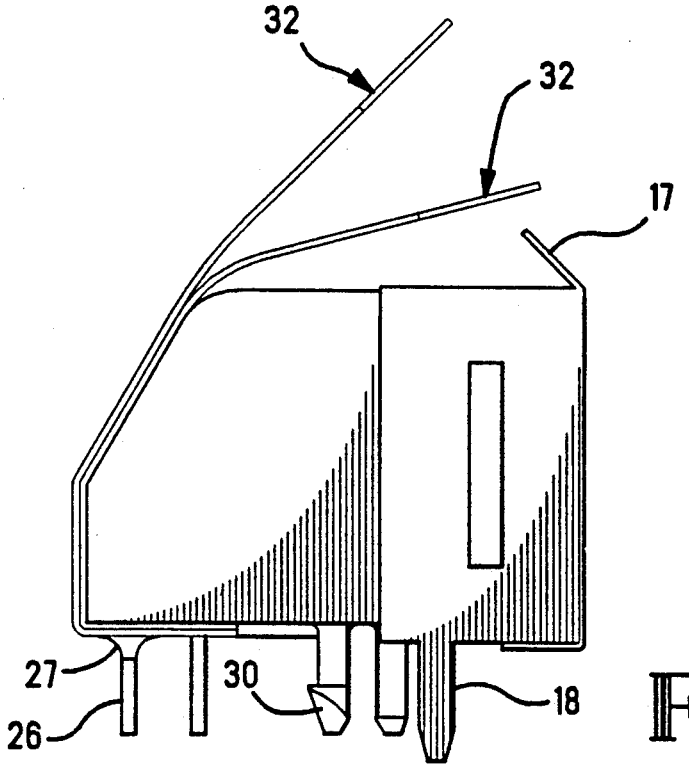
FIG. 7 is a side and elevation view of the connector of the invention just prior to complete assembly.

Construction of a connector like 12 is relatively well known, and includes a plastic housing 14 having on the face thereof a shielding and grounding structure 16 that includes posts 18 extending from the bottom of the connector as shown in FIGS. 1 and 2 for connection to circuits of the board. Housing 14 includes a series of grooves denominated 20 that extend from the top and through selected rearwardly projecting portions. Grooves 20 contain sets of signal contacts 22 and 24, offset as shown in FIG. 1, with the contacts ending in posts 28,26 coextending below the bottom surface or mounting face 25 to be terminated to conductive traces of the board, along with the grounding post 18 of shield 16. The front ends of contacts 22 and 24 (not shown) are formed to extend into the plug-receiving cavity at mating face 29 to receive pin portions of contacts of the mating plug connector connected to signal cable. Housing 14 includes a resilient mounting fastener 30 also extending from the bottom or mounting face 25 of the connector that plugs into a corresponding aperture of the circuit board served by the connector. The fastener 30 is shown in more detail in FIGS. 6 to 8 to include an interior slot, a barbed edge 31 that will latch and lock the connector housing 12 to the board prior to soldering posts 18, 26, and 28 to the board.

Figure 4:
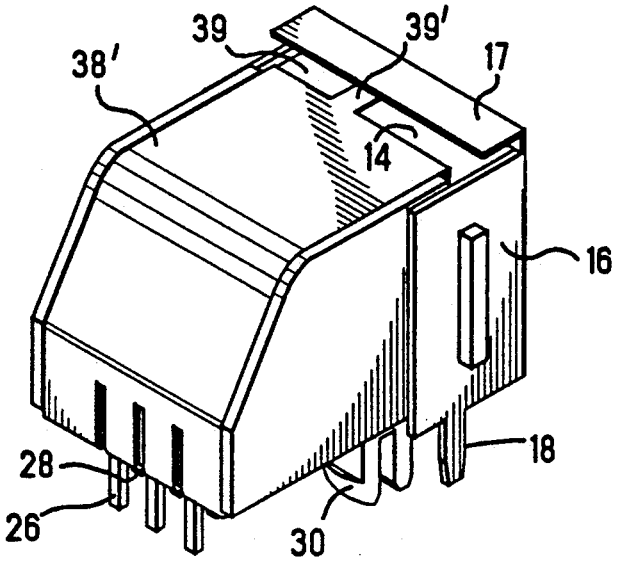
FIG. 4 is an isometric view of the connectors of FIGS. 1 and 2 in the fully assembled condition.
Figure 5:
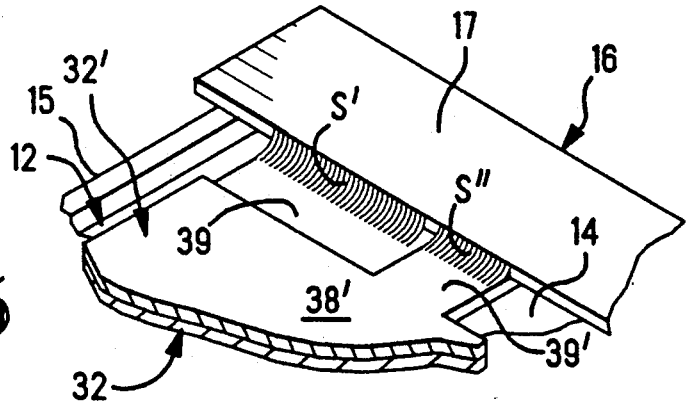
FIG. 5 is an isometric view of the end of the filter and the connection to the ground circuit of the connector.
Figure 8:
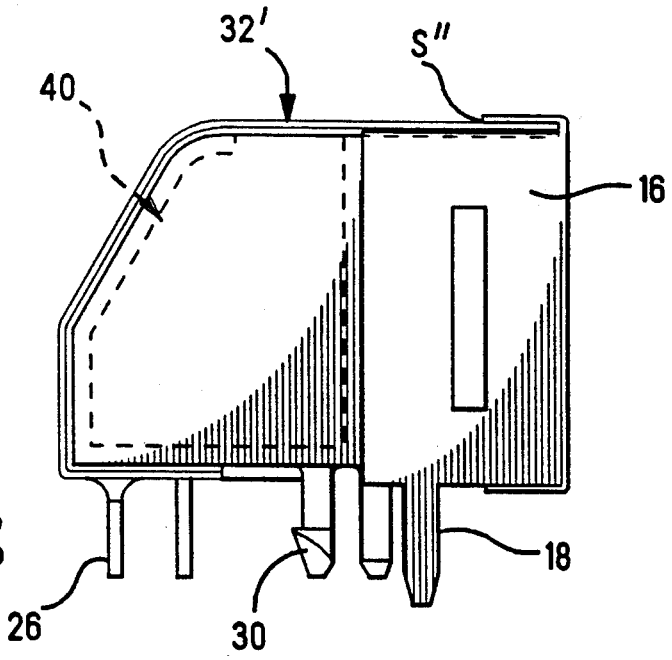
FIG. 8 is a side and elevation view of the connector as shown in FIG. 4.

The shielding structure 16 includes opposed side portions 15 and at the top thereof a portion 17 as shown in FIGS. 1, 2, 4 and 5 and, as shown in FIGS. 4, 5, and 8 is folded down against the top surface of housing 12. As can also be discerned from the various figures, the housing 12 has an exterior surface, comprised of a top, rear, sides, and a bottom. The top and sides represent relatively flat planar surfaces, the rear also containing flat surfaces as well as the reliefs as shown in the various figures.

Figure 3:
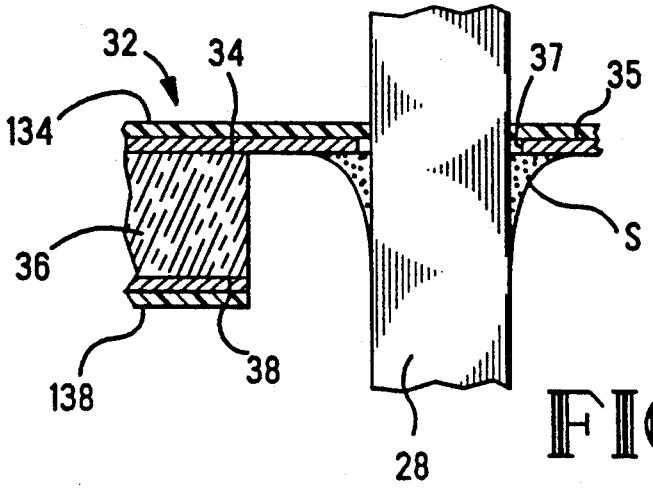
FIG. 3 is a side, elevation and partially sectioned view of the end of the filter as connected to a contact of the connector.

In accordance with the invention, representative filters are included for two of the six signal contacts, the filters being shown carried by two filter elements 32 and 32'; it being understood that all six signal conductors can be filtered in the manner to be described. As can be seen in FIG. 1, the filter element 32 includes an upper electrode 34 and a lower electrode 38. A substrate of dielectric material 36 is provided therebetween in the manner shown in FIG. 3. At the forward end of the element 32 is a finger 35 of upper electrode 34 defining a signal connection section, apertured as at 37 with the aperture aligned to receive the inner post 28 inserted therethrough and soldered thereto as by a solder fillet S as shown in FIG. 3. At the rear is a grounding finger 39 of lower electrode 38 defining a ground connection section that is soldered to ground shielding structure 16 in final assembly. Posts 26,28 defining signal connection sites spaced from each other, and top portion 17 of shield 16 defines a ground connection site remote from all signal connection sites. Finger 35 is shown laterally staggered and otherwise electrically separated from the other filter element 32' to allow clearance and nonengagement with a post 26 extending therepast for termination to electrode 34' of element 32', noting the finger 35' and aperture 37' associated with post 26. Element 32' also includes a grounding finger 39'.

Each of the filter elements is comprised then of an upper electrode 34 and a lower electrode 38 separated by a substrate 36 of dielectric material such as by etching after lamination to a sheet of the dielectric material. Such an element can be formed such as by first laminating respective layers of conductive material to respective surfaces of a sheet of the dielectric material, after which an etching process defines the boundaries of the respective electrodes, in which process a plurality of such tape filters can conveniently be fabricated. Preferably outwardly facing surfaces of the electrodes has an insulative covering after etching, such as by spraying with a polymer paint or by lamination to a polymeric film except at soldering sites of the electrodes. The individual electrodes 34,34', one for each of the signal contacts associated with one post 28 and one for each signal contact associated with one post 26 and with common grounding electrodes 3B and 38', have areas selected in conjunction with the particular dielectric material having a particular dielectric constant and the thickness of the coating 36 to provide a desired capacitance associated with each signal contact and, in essence, connecting each signal contact through the capacitive material to ground through the common ground electrode 38. As is well known, capacitance is a function of area of electrode, dielectric constant of the dielectric material, and the spacing between electrodes with capacitance values decreasing as the space between electrodes is increased and with capacitance increasing with the dielectric value increasing.

In accordance with one embodiment of the invention, the electrodes were formed of a foil on the order of about 0.0014 inches thick, with the substrate on the order of 0.002 inches thick, the package thus formed being on the order of 0.005 inches thick. A film of polymeric material such as RHEOPLEX LC 40 acrylic emulsion adhesive sold by Rohm and Haas, Inc., Philadelphia, Pa. having a matrix of acrylic polymer with barium titanate filler homogeneously dispersed therein on the order of about fifty percent by weight, with particle size of a bout one micron, was employed for the dielectric material. The conductive layers were of half-ounce copper which were joined to the sheet of dielectric material with a three-ply heat and pressure laminating machine.

The lamination thus formed found to have a capacitance varying between 400 and 480 picofarads when the individual electrodes were on the order of 0.200 inches wide and 1 inch in length. The resulting capacitance provided an attenuation beginning at on the order of several Db insertion loss at slightly less than 10 Mhz rising to on the order of 12 to 15 dB at around 100 Mhz and peaking for the 400 picofarad capacitance at about 34 dB at around 250 MHz. The 480 picofarad sample had an insertion loss at slightly less than 30 dB at a frequency of around 200 to 300 MHz. The use of an appropriate amount of barium titanate in the polymer further provides a voltage withstanding of 1000 volts or greater, needed for certain FCC requirements.

Alternatively a pair of opposing foils of anodized aluminum could be utilized, laminated to a sheet of the barium titanate filled polymer; or a coating of barium titanate filled polymer may be screen printed or sprayed onto one sheet of foil as the other foil sheet is then laminated thereonto; and then after application of masking of appropriately geometry, the foil sheets are etched in conventional manner to result in a structure similar to the etched electrode structure described above, after which dielectric coating such as 350 CC epoxy sold by Mavidon Corp., Palm City, Fla., may be applied to one or both electrode outer surfaces. The tape filters may then be cut from the sheet of dielectric material.

The filters 32 and 32' were in turn laminated with a thin insulating film shown as layers 134 and 138 in FIG. 3. In the embodiment shown, layer 138 is between filter elements 32 and 32' thereby electrically isolating electrode 38 from electrode 34', in the fashion shown in FIG. 2 with the various separate electrodes soldered to the various contacts 22 and 24 at respective post portions 26 and 28. The lamination was folded around from the bottom of the connector housing 14, up the back, resting on the flat surfaces thereof, and across the top in the manner shown in FIG. 7, traversing grooves 20 and 18 seen in FIGS. 1 and 2 and being disposed between raised lips 41 of housing 12 for protection against the side edges being snagged and the filters becoming dislodged or otherwise stressing the solder termination joints. The filter elements 32,32' are shaped and dimensioned such that the signal connection sections defined by fingers 35,35' are staggered with respect to each other and are adjacent respective signal connection sites (posts 26,28); ground connection sections defined by fingers 39,39' are staggered with respect to each other and are adjacent the ground connection site defined by top portion 17 of shield 16.

With the end of the elements 32 and 32' folded down against the upper surface, the projection 17 was then folded down over the top of the fingers 39 and 39' of the filters in the manner shown in FIG. 8 and in the manner shown in FIG. 5. As can be seen in FIG. 5, a solder fillet S' interconnects finger 39 of electrode 38 to projection 17 and thus to shielding; structure 16 and the fillet solder S'' connects the finger 39' to electrode 38' of element 32' to the same grounding structure. In this fashion, two filter elements such as 32 and 32' may be folded as shown and terminated to the grounding structure. It may be desired after soldering, for a plastic covering to be molded over the filter tapes for protection thereof, or alternatively a premolded plastic cover to be secured to the connector over the filter tapes by conventional methods to protect the filter tapes.

The invention contemplates additional elements such as 32 that may be individually grounded rather than commonly grounded as shown and terminated by using fingers such as 39 and 39' appropriately. The invention also contemplates that where necessary to achieve a desired capacitance, the area of the electrodes, such as electrodes 34, may be increased for a given signal contact with additional elements provided for the remaining signal electrodes. Also contemplated is the use of additional area achieved by providing electrodes 40 extending over the sides of the housing in the manner shown in phantom in FIG. 8, such additional area providing an increased capacitance for the device.

Figure 9:
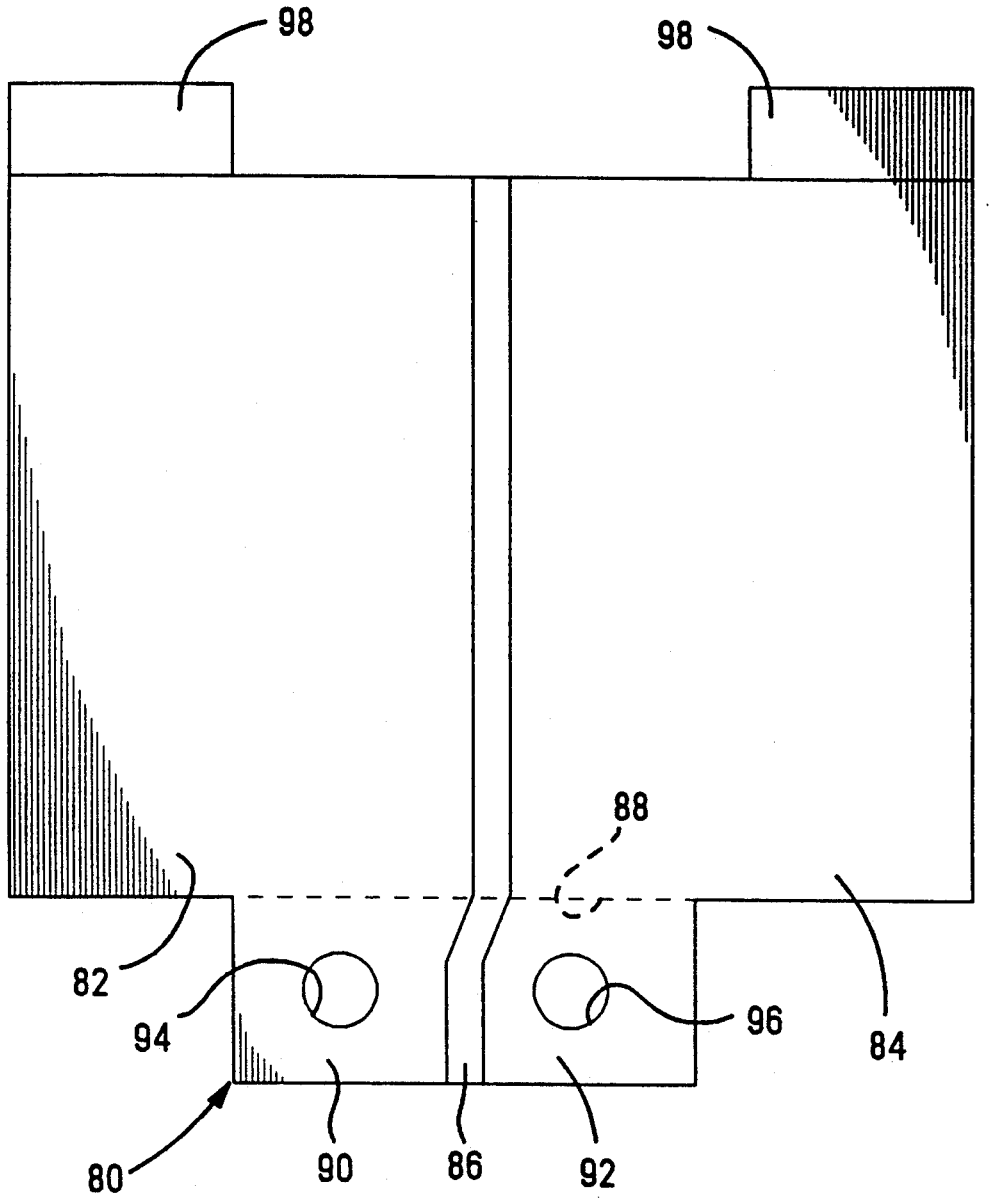
FIG. 9 is a plan view of an alternate embodiment of tape filter showing a pair of signal electrodes.

The invention contemplates a use with one signal contact and one ground contact or with two, four, or six contacts. For example, FIG. 9 is an alternate embodiment of tape filter 80 adapted to filter two circuits by means of one tape structure. Tape filter 80 is shown having two signal electrodes 82,84 on a common side of the dielectric substrate, separated by a gap 86. A single common ground electrode 88 is disposed across the opposed surface of the substrate. Each of the signal electrodes 82,84 have respective fingers 90,92 extending to traverse the axis of the corresponding signal terminals of the connector (not shown), with the terminals received through respective apertures 94,96 through the fingers 90,92 and soldered thereto, upon assembly of the tape filter to the connector. Ground electrode 88 is shown to include grounding fingers 98 extending beyond the extend of signal electrodes 82,84 for soldering to a ground shield of the connector (not shown).

Various layouts utilizing various portions of the exterior area of the housing may be employed with adequate areas for the desired capacitance as indicated. Having now described the invention to enable a preferred practice thereof, claims are appended intended to define what is inventive.

We claim:

1. In combination an electrical connector of a type adapted to connect circuits carrying signals having unwanted frequency components between a signal source and a component driven by such signals and a plurality of filter elements adapted to filter out said unwanted frequency components, the connector including a housing having a plurality of signal contacts and a grounding means, and at least one tape member flexible and shapeable to conform to the outer housing of said connector and be secured thereto in its conformed condition, each tape member having at least one signal electrode defined on a first side thereof each said signal electrode being connected to a respective said signal contact, and a ground electrode defined on a second side of each said at least one tape member connected to said grounding means, a said filter element being defined by a portion of each said at least one tape member by a said signal electrode and an opposing said ground electrode thereon, with each said plurality of filter elements including electrically disposed between each said signal electrode and said ground electrode thereof a layer of dielectric material having characteristics to transmit the unwanted signal frequency components from the signal contact to the grounding means, said connector having an exterior surface containing relatively flat portions substantially free of protrusions between said plurality of signal contacts and said grounding means, each said filter element having a thin flat configuration extending over portions of said flat surface to conform at least in part to the geometry of said surface thereby minimizing the volume of the filter element/connector combination while filtering a preexisting electrical article without modification thereof being necessary.

2. The combination of claim 1 wherein sid signal and ground electrodes of each said filter element are of an area and spacing which in combination with the dielectric material provides a capacitance C selected to pass the unwanted frequencies to ground and isolate the signal contacts from ground with respect to wanted signal components.

3. The combination of claim 1 wherein parameters of signal electrode area, ground electrode area, dielectric thickness, and dielectric material are selected to provide an increasing insertion loss with respect to signals beginning in the range of 10 MHz up to on the order of 130 MHz with the insertion loss extending above 20 dB.

4. The combination of claim 1 wherein said dielectric material and spacing between electrodes is selected to provide withstanding voltage of 1000 volts or better.

5. The combination of claim 1 wherein parameters of signal electrode are, ground electrode area, dielectric material, and electrode spacing was selected to provide capacitance C on the order from 400 to 500 picofarads or greater at an insertion loss on the order of between 20 and 30 dB.

6. The combination of claim 1 including a plurality of tape members each with one said signal electrode, said signal electrodes having respective signal connection sections staggered for electrical connection respectively connected to corresponding said signal contacts.

7. The combination of claim 1 including a plurality of tape members with respective said grounding electrodes of said filter elements having respective ground connection sections staggered for electrical connection to a common grounding means of said article at a grounding connection site thereof.

8. The combination of claim 1 including a plurality of tape members with respective ones of said grounding electrodes of said filter elements being commoned.

9. The combination of claim 8 wherein ends of said tape members include portions of different lengths to facilitate a separate connection of said signal and ground electrodes with respective said signal and ground contacts.

10. The combination of claim 1 wherein said signal contacts and ground means are attached to said housing of said connector with each including a post extending from a connecting face of said connector and with said signal and ground electrodes connected to said posts of said signal contacts and grounding means respectively, and each said at least one tape member is folded around and secured to exterior surfaces of said housing.

11. The combination of claim 1 wherein each said plurality of filter elements includes additionally at least one further layer of insulating film of flexible nature as a carrier and to isolate each said signal and ground electrode.

12. The combination of claim 1 wherein said at least one tape member is disposed adjacent the exterior surface of said housing, with side edges thereof disposed between raised lips of said housing.

13. The combination of claim 1 wherein at least one said tape member includes at least a second said signal electrode disposed along said one side thereof and spaced and electrically isolated from others of said signal electrodes thereof along said one side thereof and from said ground electrode thereof, said second signal electrode including a respective signal connection section staggered from signal connection sections of said others of said signal electrodes thereof and from signal connection sections of others of said plurality of said signal electrodes of said plurality of filter elements, for electrical connection respectively to a corresponding one of said plurality of signal contacts.

14. In combination an electrical article of a type having circuits carrying signals having unwanted frequency components between a signal source and a component driven by such signals and a plurality of filter elements adapted to filter out said unwanted frequency components, said article having a plurality of signal circuits and a grounding means, said article having an exterior surface containing relatively flat portions with said signal circuits and said grounding means at least extending to said exterior surface at respective spaced apart signal and ground connection sites respectively and electrically connected thereto, and at least one tape member flexible and shapeable to conform to the exterior shape of said article and be secured thereto, each said at least one tape member having at least one signal electrode on one side thereof, associated with a respective said signal circuit and containing a signal connection section and further containing one ground electrode on an opposed side thereof associated with said grounding means and containing a ground connection section, a said filter element being defined by a portion of each said at least one tape member by a said signal electrode and an opposing said ground electrode thereon, each said signal and ground connection section being laterally offset from others thereof, each said filter element including electrically disposed between said signal and ground electrodes thereof a layer of dielectric material having characteristics to transmit the unwanted signal frequency components from said signal circuit to said ground means, each said at least one tape member being secured to said article along said exterior surface with each said signal connection section and said ground connection section corresponding to said signal and ground connection sites respectively, and each said at least one tape member having a thin flat configuration extending over portions of said flat surface to conform at least in part of the geometry of said surface thereby minimizing the volume of the filter element/article combination while filtering a preexisting electrical article without modification thereof being necessary.

15. In combination an electrical connector of a type adapted to connect circuits carrying signals having unwanted frequency components between a signal source and a component drive by such signals and at least one filter element adapted to filter out said unwanted frequency components, the connector including a housing having a plurality of signal contacts and a grounding means, a like plurality of signal electrodes defined on a first side of said at least one filter element, each signal electrode being connected to a respective said signal contact, and a ground electrode defined on a second side of each said at least one filter element connected to said grounding means, said at least one filter element further including at least a second said signal electrode disposed along said one side thereof and spaced and electrically isolated from others of said signal electrodes thereof along said one side thereof and from said ground electrode thereof, said second signal electrode including a respective signal connection section staggered from signal connection sections of said others of said signal electrodes thereof and from signal connection sections of others of said plurality of said signal electrodes of said at least one filter element, for electrical connection respectively to a corresponding one of said plurality of signal contacts, each said at least one filter element including electrically disposed between each said signal electrode and said ground electrode thereof a layer of dielectric material having characteristics to transmit the unwanted signal frequency components from the signal contact to the grounding means, said connector housing having an exterior surface containing relatively flat portions substantially free of protrusions between said plurality of signal contacts and said grounding means, said at least one filter element having a thin flat configuration extending over portions of said flat surface to conform at least in part to the geometry of said surface thereby minimizing the volume of the filter element/connector combination while filtering a preexisting electrical article without modification thereof being necessary.

* * * * *

UNITED STATES PATENT AND TRADEMARK OFFICE

CERTIFICATE OF CORRECTION

PATENT NO. : 5,277,625

DATED : January 11, 1993

INVENTOR(S) : James F. Iannella et al.

It is certified that error appears in the above-identified patent and that said Letters Patent is hereby corrected as shown below:

COLUMN 7,

Claim 5, line 48, "are" should be --area--.

Column 8,

Claim 10, line 5, "ground" should be --grounding--.

Claim 14, line 47, "shape" should be --surface--; line 32, "ground" should be --grounding--.

Column 9,

Claim 15, line14, "drive" should be --driven--.

Signed and Sealed this

Fourteenth Day of June, 1994

Bruce Lehman

*Attest:*

BRUCE LEHMAN

*Attesting Officer*

*Commissioner of Patents and Trademarks*